US012442611B2

(12) United States Patent
Puha

(10) Patent No.: US 12,442,611 B2
(45) Date of Patent: Oct. 14, 2025

(54) MODULAR SUPPRESSOR WITH BEVELED SEGMENTS

(71) Applicant: Eight Holdings LLC, Coeur D'Alene, ID (US)

(72) Inventor: Teodor Puha, Coeur D-Alene, ID (US)

(73) Assignee: Eight Holdings, LLC, Coeur D'Alene, ID (US)

( * ) Notice: Subject to any disclaimer, the term of this patent is extended or adjusted under 35 U.S.C. 154(b) by 0 days.

(21) Appl. No.: 18/516,643

(22) Filed: Nov. 21, 2023

(65) Prior Publication Data

US 2024/0288240 A1 Aug. 29, 2024

Related U.S. Application Data

(60) Provisional application No. 63/427,010, filed on Nov. 21, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS

| | | | | |
|---|---|---|---|---|
| 2,780,962 | A * | 2/1957 | Ressler | F41A 21/30 89/14.2 |
| 9,097,482 | B1 * | 8/2015 | Holden | F41A 21/30 |
| 9,347,727 | B1 * | 5/2016 | Cler | F41A 21/30 |
| 9,482,484 | B2 * | 11/2016 | Barney | F41A 21/30 |
| 10,890,401 | B2 * | 1/2021 | Sautmann | F41A 21/30 |
| 11,506,463 | B1 * | 11/2022 | Kunsky | F41A 21/30 |
| 11,668,541 | B2 * | 6/2023 | Grob | F41A 21/30 89/14.4 |
| 11,774,205 | B1 * | 10/2023 | Kunsky | F41A 21/30 89/14.4 |
| 2016/0018178 | A1 * | 1/2016 | Johansen | F41A 21/30 181/223 |
| 2018/0347931 | A1 * | 12/2018 | Schoppman | F41A 21/36 |
| 2019/0204038 | A1 * | 7/2019 | Conner | F41A 21/30 |
| 2021/0041200 | A1 * | 2/2021 | Kras | F41A 21/30 |
| 2021/0389072 | A1 * | 12/2021 | Bray | F41A 21/30 |

* cited by examiner

*Primary Examiner* — Troy Chambers
*Assistant Examiner* — Benjamin S Gomberg
(74) *Attorney, Agent, or Firm* — Eric B. Fugett; Mark A. Pitchford; Pitchford Fugett, PLLC

(57) ABSTRACT

A suppressor for a gun is compatible with expanding projectiles (e.g., shot shells, pepper balls, bean bags, etc.). The suppressor includes a core configured to attached to a barrel of the gun and extend forward from the barrel. One or more baffles attaches to an external surface of the core between a rear end and a front end of the core. A housing generally surrounds the baffle and core. An end cap attaches to a front of the housing to define the front of the suppressor. The core includes a plurality of annular segments or bushings configured to limit expansion of the projectile as it traverses the suppressor, and the annular segments or bushings are spaced apart from one another and supported by rails.

16 Claims, 10 Drawing Sheets

MODULAR SUPPRESSOR WITH BEVELED SEGMENTS

CROSS-REFERENCE TO RELATED APPLICATIONS

This application is a non-provisional application of and claims priority to U.S. Provisional Patent Application No. 63/427,010 entitled "MONOLITHIC SUPPRESSOR FOR A FIREARM" filed Nov. 21, 2022.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FEDERALLY SPONSORED RESEARCH AND DEVELOPMENT

Not Applicable

BACKGROUND OF THE INVENTION

The present invention relates generally to sound suppression devices. More particularly, the present invention relates to sound suppression for guns for use with projectiles other than bullets (e.g., shot shells, less than lethal projectiles, etc.).

Suppressors for guns, especially firearms are used to reduce noise levels and/or suppress or hide muzzle flash. Suppressors may be used on firearms or other guns such as air powered guns, especially pre-charged pneumatic guns. Suppressors use baffles and expansion chambers to reduce the noise emitted by a gun as the projectile exits the gun. Pistols and rifles shoot projectiles (i.e., bullets) that do not expand until impact with a target. That is, they maintain diameter when exiting a muzzle of the gun and passing through a suppressor affixed or integrated with the gun. Because the projectile maintains its diameter, baffles in the suppressor need only have a bore at least as large as the projectile and aligned with the path of travel of the projectile. The baffles only need to manage expanding gases, not any solid object impacts, and the baffles are therefore relatively thin and straight to minimize weight and material usage.

Suppressing guns that utilize expanding projectiles (e.g., shot shells, less lethal rounds, bean bags, pepper balls, etc.) is more challenging than typical ball ammunition or hollow point ammunition guns because the projectile diameter may increase as the projectile leaves the muzzle of the gun and travels through the suppressor. The suppressor must therefore limit projectile expansion within the suppressor to prevent the projectile from excessively impacting the baffles in the suppressor, destroying the projectile and the suppressor. At present, there are three ways to keep the projectile from expanding in the suppressor. The first way is to use baffles that are trumpet or bell shaped as shown in U.S. Pat. No. 11,774,205 to uniformly recompress an expanding projectile as it traverses the suppressor. Trumpet or bell shaped baffles are expensive to manufacture and can wear relatively quickly, but they allow good expansion of gases into the chambers in the suppressor created by the baffles. The second way is to use guide rods spaced about the circumference of the bore of the suppressor to keep the projectile diameter consistently constrained to its initial diameter as it traverses the suppressor. These rods allow good expansion of gases into the chambers between baffles, but the rods also allow expansion of areas of the projectile such that the expanded areas contact the baffles between the rods. The third way to limit projectile expansion within the suppressor is to use a perforated tube (which essentially forms a barrel extension) with baffles outside the tube. Perforated tubes are good at maintaining the dimeter of the projectile but tend to limit the expansion of gases into the chambers of the suppressor between the baffles because too holes or holes that are too large will result in a weak tube that is subject to failure.

SUMMARY OF THE INVENTION

Aspects of the present invention provide a suppressor having a monolithic core compatible with a gun launching expanding projectiles (e.g., shot shells, pepper balls, bean bags, etc.). The suppressor includes a core configured to attached to a barrel of the gun and extend forward from the barrel. One or more baffles attaches to an external surface of the core between a rear end and a front end of the core. A housing generally surrounds the baffle and core. An end cap attaches to a front of the housing to define the front of the suppressor. The core includes a plurality of annular segments or bushings configured to limit expansion of the projectile as it traverses the suppressor, and the annular segments or bushings are spaced apart from one another and supported by rails.

In another aspect, a suppressor for a gun configured to launch a projectile from a barrel of the gun includes a core, a baffle, a housing, and an end cap. The core is configured to extend longitudinally. The core has a rear end configured to attach to the barrel of the gun and a front end opposite the rear end. The baffle is configured to attach to an external surface of the core between the rear end of the core and the front end of the core. The housing is configured to extend longitudinally about the core and the baffle. The end cap defines a front end of the suppressor and is configured to attach to a front end of the housing.

In another aspect, a gun is configured to launch a projectile. The gun includes a receive, a barrel, and a suppressor. The receiver is configured to initiate launching the projectile. The barrel is configured to convey the projectile from a rear end of the barrel at the receiver forward to a muzzle of the barrel. The suppressor for a gun configured to launch a projectile from a barrel of the gun includes a core, a baffle, a housing, and an end cap. The core is configured to extend longitudinally. The core has a rear end configured to attach to the barrel of the gun and a front end opposite the rear end. The baffle is configured to attach to an external surface of the core between the rear end of the core and the front end of the core. The housing is configured to extend longitudinally about the core and the baffle. The end cap defines a front end of the suppressor and is configured to attach to a front end of the housing.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
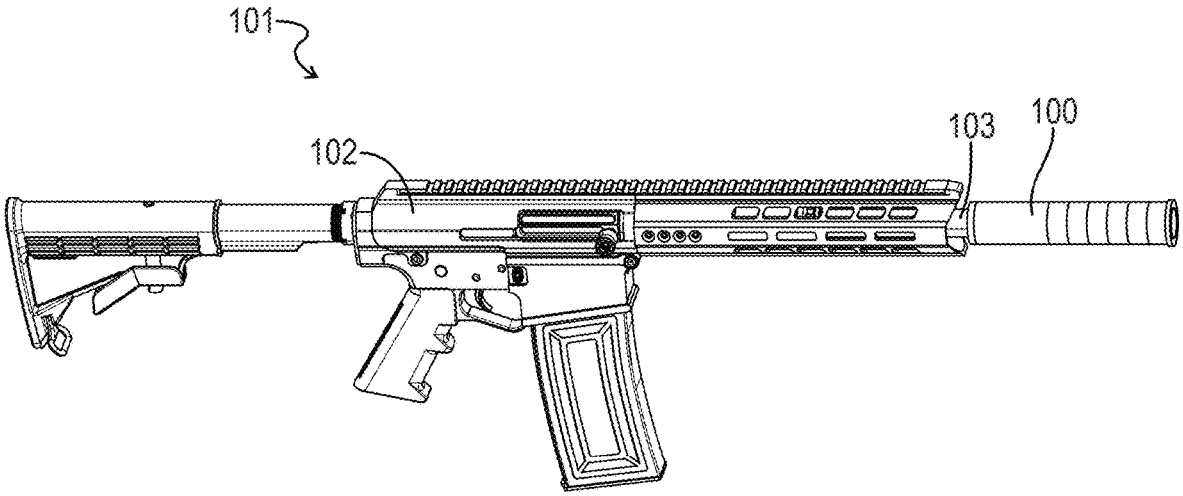
FIG. 1 is a side perspective view of a gun including a suppressor according to one embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of a gun and suppressor are when fully assembled and held in a position ready to shoot generally horizontally. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-10, a gun 101 includes a suppressor 100. The gun 101 includes a receiver 102 and a barrel 103. The receiver 102 is configured to initiate launching a projectile 105. The barrel 103 is configured to convey the projectile 105 forward from a rear end of the barrel at the receiver 102 to a muzzle of the barrel 103 at a forward end of the barrel 103.

The suppressor 100 includes a core 300, a baffle 501, a housing 503, and an end cap 505. The core 300 is configured to extend longitudinally. That is, the core 300 extends forward from the front end or muzzle of the barrel 103 along a longitudinal axis or bore axis of the barrel 103 when the gun 101 and suppressor 100 are assembled. The core has a rear end 301 configured to attach to the barrel 103 and a front end 303 opposite the rear end 301. In one embodiment, the core 300 is configured to attach to the barrel 103 via a barrel bushing 107. In one embodiment, the barrel bushing 107 is threaded onto the barrel 103, and the core 300 is threaded onto the barrel bushing. In another embodiment, the barrel bushing 107 is threaded into the barrel 103 and the core is threaded onto the barrel bushing 107. In another embodiment, a rear end of the core 300 is beveled complementary to a front end of the barrel bushing 107 such that when the core 300 is pressed against the complementary bevel in the barrel bushing 107 by the end cap 505 and housing 503, the core 300 is retained in position relative to the barrel bushing 107. In one embodiment, the barrel bushing 107 is threaded into a handguard surrounding the barrel to retain the barrel bushing 107 at the muzzle of the barrel 103.

The baffle 501 is configured to attach to an external surface 307 of the core 300 between the rear end 301 and the front end 303 of the core 300. The baffle(s) 501 extend radially outward to an inner surface of the housing 503, creating expansion chambers between the baffles 501, core 300, and housing 503. In one embodiment, the suppressor 100 includes a plurality of baffles 502, and the baffles 501 are configured to thread onto the core 300.

The housing 503 is configured to extend longitudinally about the core and the baffle(s) 501. The end cap 505 defines a front end of the suppressor 100 and is configured to attach to a front end of the housing 503. In one embodiment, the housing 503 threads onto the barrel bushing 503, and the end cap 505 threads into the housing 503. In one embodiment, the forward end 303 of the core contacts the end cap 505 to support the forward end 303 of the core 300. In one embodiment, the end cap 505 includes a plurality of teeth 313 extending forward of the housing 503. The teeth 313 can be used to engage a door hinge or latch to use the gun 101 as a breaching tool.

Figure 2:
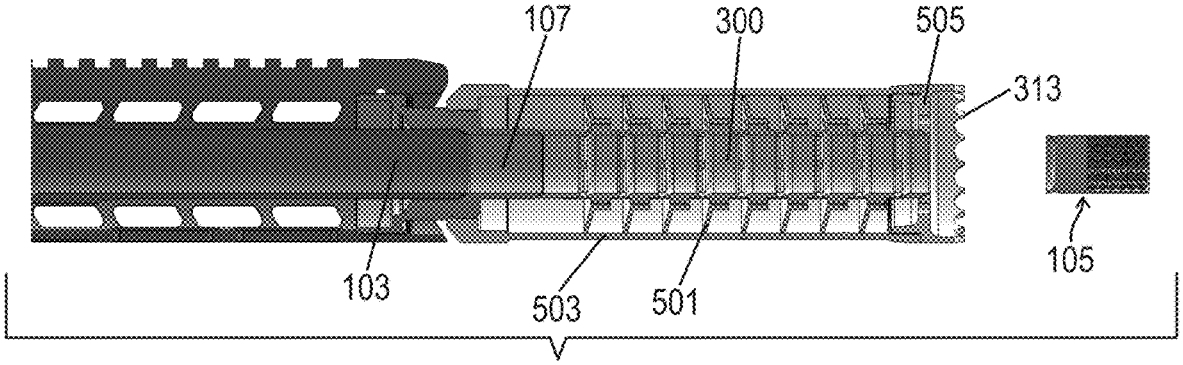
FIG. 2 is a side cutaway view of the gun and suppressor of FIG. 1 showing a shot shell exiting the suppressor.
Figure 3:
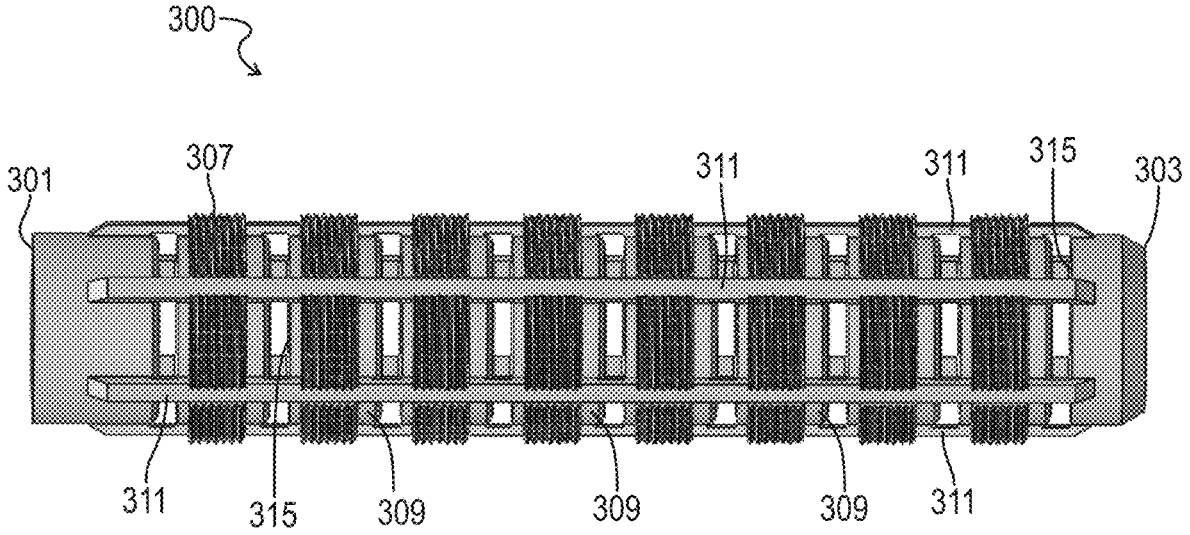
FIG. 3 is a side perspective view of the monolithic core or cage of the suppressor of FIG. 1.
Figure 4:
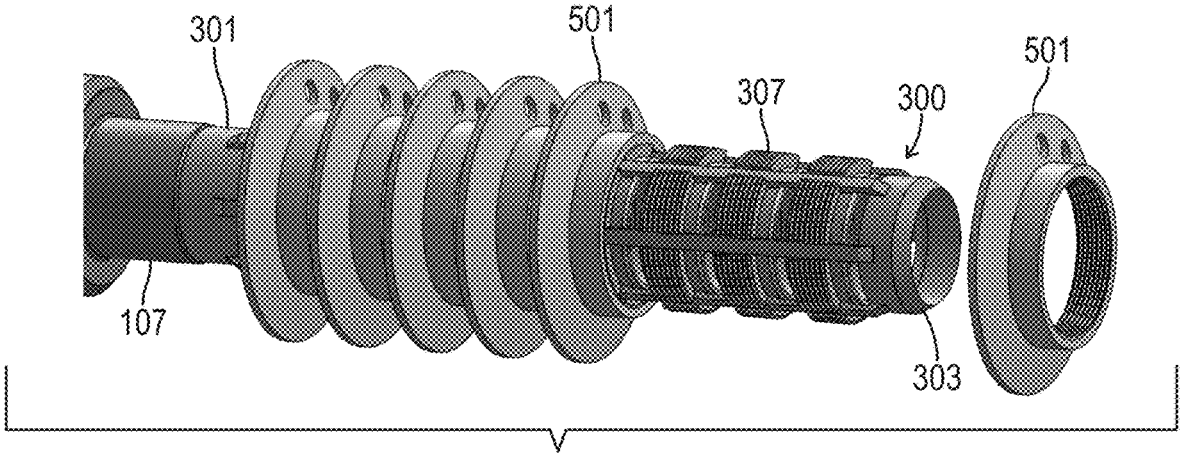
FIG. 4 is an isometric view of the suppressor of FIG. 1.

Referring especially to FIGS. 2-4, in one embodiment, the core 300 includes a plurality of annular segments 309 and rails 311. The plurality of annular segments 309 are spaced apart from one another and supported by the plurality of rails 311. The plurality of annular segments 309 are attached to and supported by the plurality of rails 311. In one embodiment, the plurality of rails 311 and the plurality of annular segments 309 are integrally formed. In one embodiment, a rear end of each of the annular segments 309 is beveled such that a rear edge 315 of the annular segment has a larger diameter than a minimum diameter of the annular segment, and the minimum diameter of the annular segment is approximately equal to a bore diameter of the barrel 103 of the gun 101. In one embodiment, an annular segment 309 includes threads forming the external surface 307 of the core 300. The baffle 501 is configured to engage the threads 307 such that the baffle 501 is retained radially and longitudinally relative to the annular segment 309. In one embodiment, the rails 311 are radially spaced from the longitudinal axis (i.e., the bore axis) the same distance as an outer diameter of the rear edge 315. That is, the projectile 105 should not normally expand to contact the rails 311 between annular segments 309, but the rails 311 will prevent any expansion beyond the maximum diameter of the annular segments 309 if an irregular operation occurs or a defective projectile 105 is launched.

Figure 5:
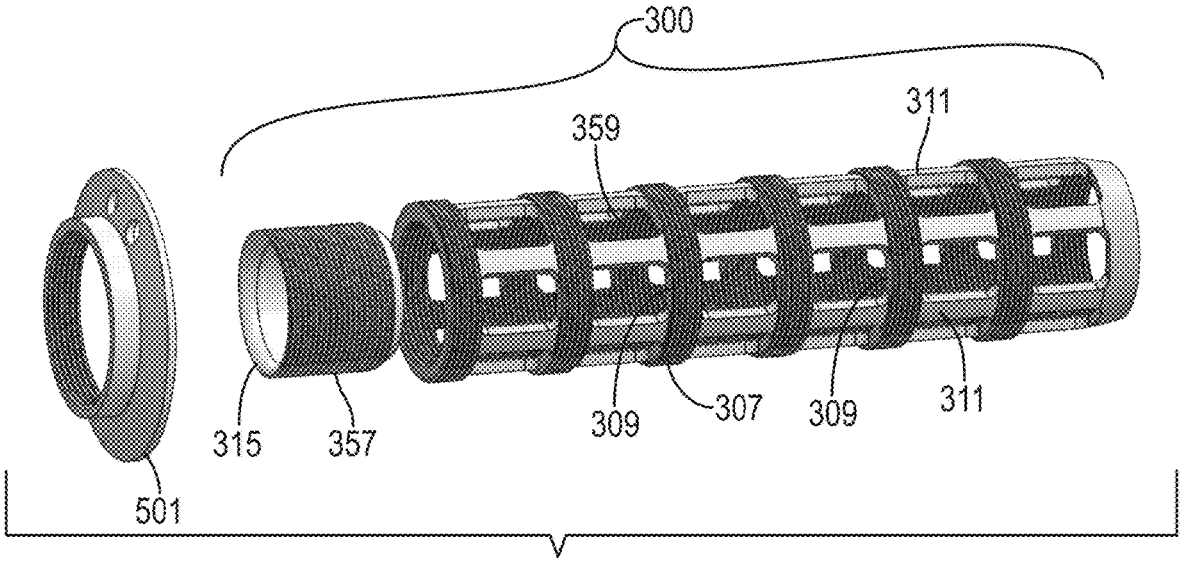
FIG. 5 is an isometric partially exploded view of a core for a suppressor, according to a second embodiment of the invention.
Figure 6:
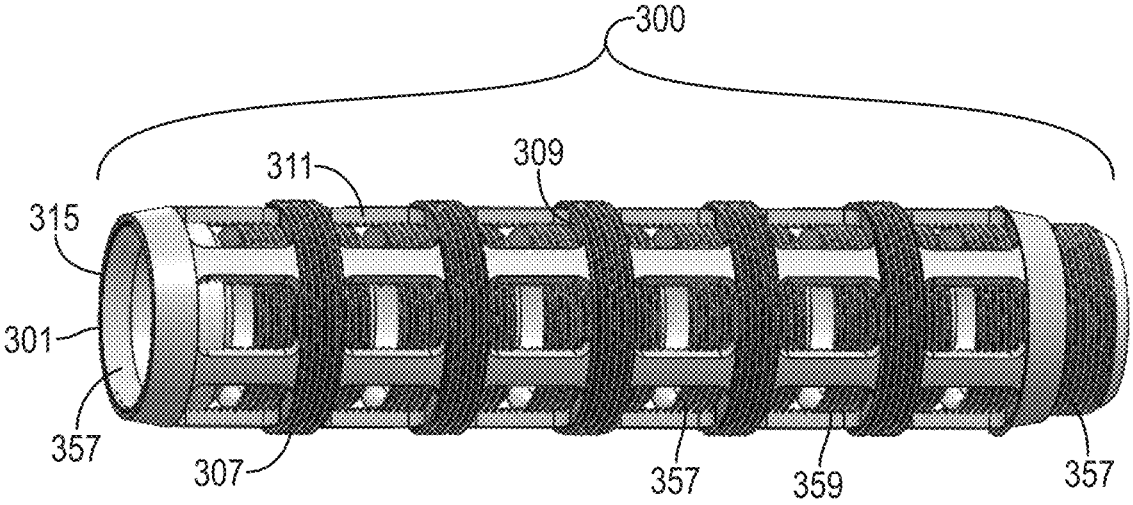
FIG. 6 is an isometric view of the core of FIG. 5.
Figure 7:
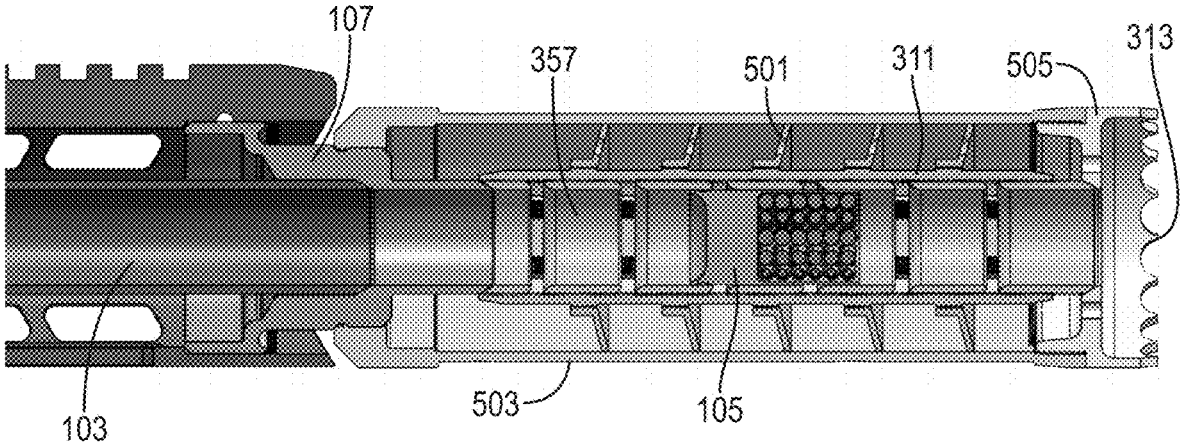
FIG. 7 is a side cutaway view of a gun including the suppressor of FIGS. 5 and 6 firing a shot shell.

Referring especially to FIGS. 5-7, in one embodiment, the core 300 includes annular segments 309 and rails 311 forming a cage (e.g., a monolithic core). The core 300 further includes a plurality of bushings 357. The plurality of bushings 357 engage a radially inward surface 359 of the cage. The plurality of bushings 357 are longitudinally spaced from one another when the suppressor 100 is assembled. In one embodiment, each bushing 357 of the plurality of bushings is beveled such that a rear edge 315 of the bushing 357 has a larger diameter than a minimum diameter of the bushing 357, and the minimum diameter of the bushing 357 is equal to or larger than the bore diameter of the barrel 103 of the gun 100. That is, the minimum diameter of the core 300 is approximately equal to the diameter of the barrel 103 and an outer diameter of the projectile 105.

Figure 8:
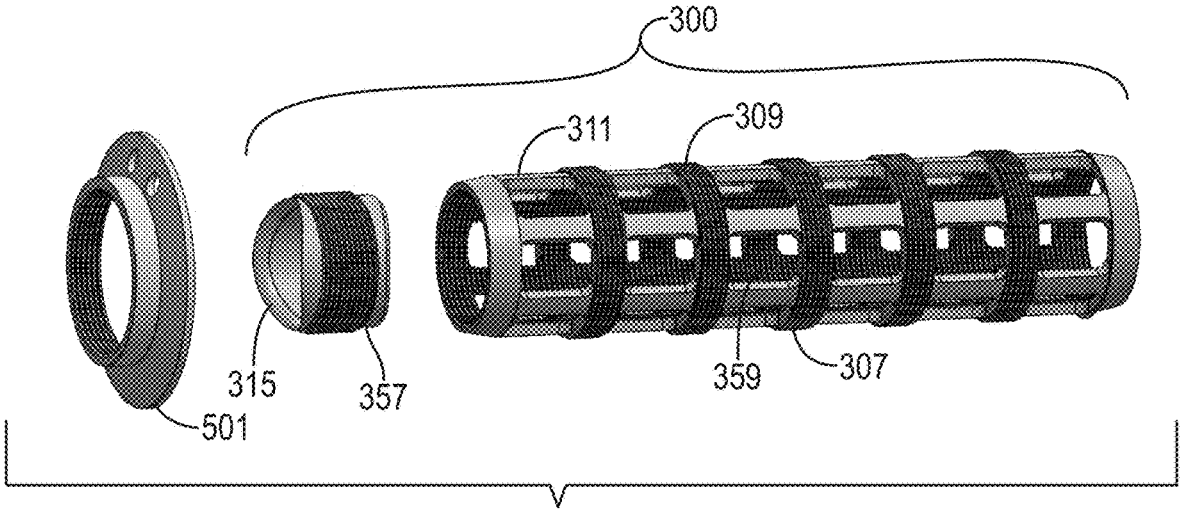
FIG. 8 is an isometric partially exploded view of a core for a suppressor according to a third embodiment of the invention.
Figure 9:
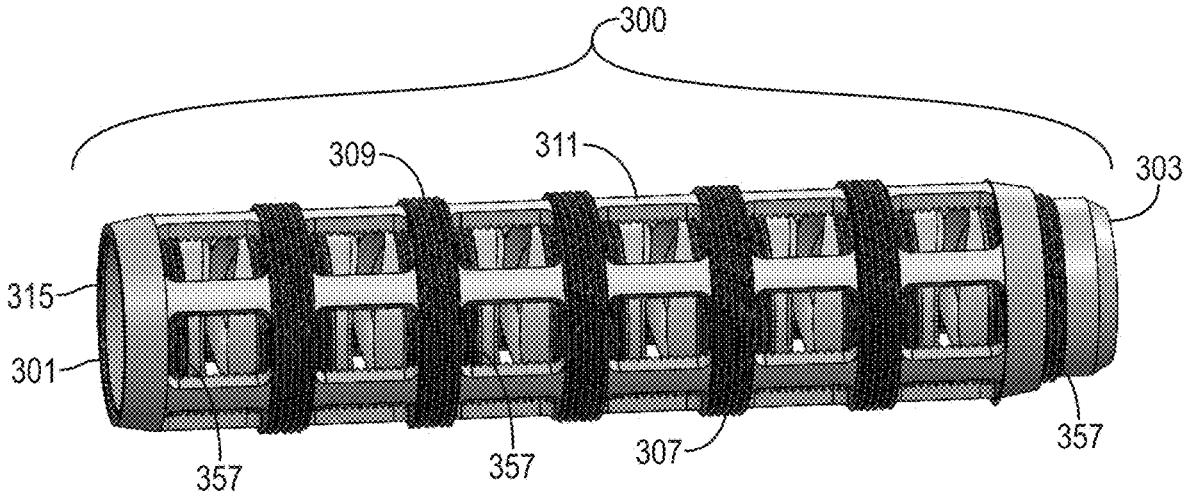
FIG. 9 is an isometric view of the suppressor core of FIG. 8.
Figure 10:
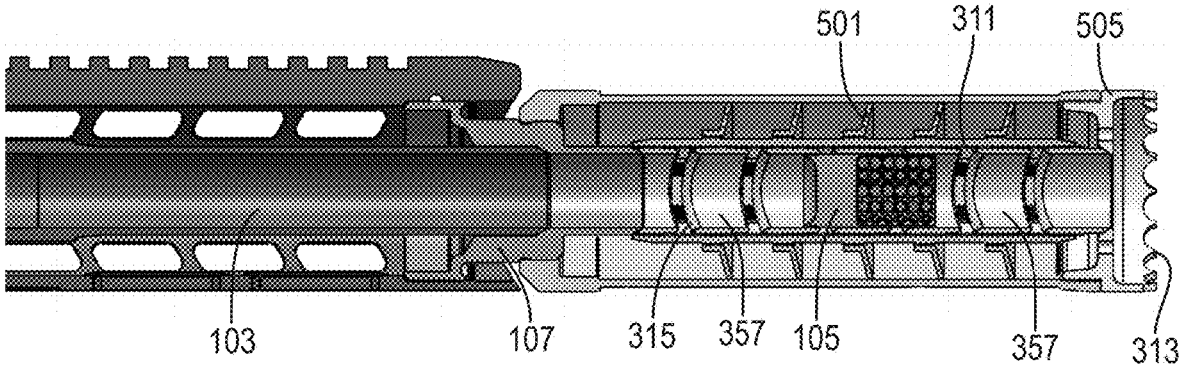
FIG. 10 is a side cutaway of a gun including the suppressor of FIGS. 8 and 9 firing a shot shell.

Referring especially to FIGS. 8-10, in one embodiment, the core 300 includes a plurality of bushings 357 having a rear edge 315 that forms a hyperbolic paraboloid. Thus, instead of having annular spaces between the bushing 357, the spaces between the bushings have a shape that varies areas of the projectile 105 that could expand as the projectile passes between bushings 357 which will help to limit expansion of the projectile 105 and friction with the bushings 357 without hindering expansion of gases propelling the projectile 105 into the chambers between the baffles 501. In one embodiment, the rear edge 315 of the bushing 357 is generally flush with an inner surface of the rail 311 of the cage.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MONOLITHIC SUPPRESSOR FOR A GUN it is not intended that such references be construed as limitations upon the scope of this invention except as set forth in the following claims.

What is claimed is:

1. A suppressor for a gun configured to launch a projectile from a barrel of the gun, said suppressor comprising:

a core configured to extend longitudinally, said core having a rear end configured to attach to the barrel of the gun and a front end opposite the rear end;

a baffle configured to attach to an external surface of the core between the rear end of the core and the front end of the core;

a housing configured to extend longitudinally about the core and the baffle; and an end cap defining a front end of the suppressor, said end cap configured to attach to a front end of the housing, wherein:

the core comprises a plurality of annular segments extending longitudinally, said plurality of annular segments spaced apart from one another and supported by a plurality of rails attached to each of the annular segments of the plurality of annular segments;

the plurality of annular segments and the plurality of rails are integrally formed; and each of the annular segments is beveled such that a rear edge of the annular segment has a larger diameter than a minimum diameter of the annular segment and the minimum diameter of the annular segment is approximately equal to a bore diameter of the barrel of the gun.

2. The suppressor of claim 1, wherein:

the core is configured to attach to the barrel of the gun via a barrel bushing.

3. The suppressor of claim 1, wherein:

the core is configured to attach to the barrel of the gun via a barrel bushing; and the housing is configured to attach to the barrel bushing.

4. The suppressor of claim 1, wherein:

the suppressor further comprises a barrel bushing configured to attach to the barrel of the gun by threading into the barrel of the gun;

the core is configured to attach to the barrel of the gun via the barrel bushing; and the housing is configured to attach to the barrel bushing by threading onto the barrel bushing.

5. The suppressor of claim 1, wherein:

the suppressor comprises a plurality of baffles configured to thread onto the core; and the baffle is one baffle of the plurality of baffles.

6. The suppressor of claim 1, wherein:

the end cap is configured to attach to the front end of the housing by threading into the housing; and the end cap comprises a plurality of teeth configured to extend forward of the housing when the end cap is attached to the housing.

7. The suppressor of claim 1, wherein:

an annular segment of the plurality of annular segments comprises the external surface of the core, and the external surface comprises threads thereon, said threads configured to engage the baffle such that the baffle is retained radially and longitudinally relative to the annular segment.

8. A gun configured to launch a projectile, said gun comprising:

a receiver configured to initiate launching the projectile;

a barrel configured to convey the projectile from a rear end of the barrel at the receiver forward to a muzzle of the barrel; and a suppressor comprising:

a core configured to extend longitudinally, said core having a rear end configured to attach to the barrel of the gun and a front end opposite the rear end;

a baffle configured to attach to an external surface of the core between the rear end of the core and the front end of the core;

a housing configured to extend longitudinally about the core and the baffle; and an end cap defining a front end of the suppressor, said end cap configured to attach to a front end of the housing, wherein:

the core comprises a plurality of annular segments extending longitudinally, said plurality of annular segments spaced apart and supported by a plurality of rails attached to each of the annular segments of the plurality of annular segments;

the plurality of annular segments and the plurality of rails are integrally formed; and each of the annular segments is beveled such that a rear edge of the annular segment has a larger diameter than a minimum diameter of the annular segment and the minimum diameter of the annular segment is approximately equal to a bore diameter of the barrel.

9. The gun of claim 8, wherein:

the core is configured to attach to the barrel of the gun via a barrel bushing.

10. The gun of claim 8, wherein:

the core is configured to attach to the barrel via a barrel bushing; and the housing is configured to attach to the barrel bushing.

11. The gun of claim 8, wherein:

the suppressor further comprises a barrel bushing configured to attach to the barrel by threading into the barrel;

the core is configured to attach to the barrel via the barrel bushing; and the housing is configured to attach to the barrel bushing by threading onto the barrel bushing.

12. The gun of claim 8, wherein:

the suppressor comprises a plurality of baffles configured to thread onto the core; and the baffle is one baffle of the plurality of baffles.

13. The gun of claim 8, wherein:

the end cap is configured to attach to the front end of the housing by threading into the housing; and the end cap comprises a plurality of teeth configured to extend forward of the housing when the end cap is attached to the housing.

14. The gun of claim 8, wherein:

an annular segment of the plurality of annular segments comprises the external surface of the core, and the external surface comprises threads thereon, said threads configured to engage the baffle such that the baffle is retained radially and longitudinally relative to the annular segment.

15. A suppressor for a gun configured to launch a projectile from a barrel of the gun, said suppressor comprising:

a core configured to extend longitudinally, said core having a rear end configured to attach to the barrel of the gun and a front end opposite the rear end;

a baffle configured to attach to an external surface of the core between the rear end of the core and the front end of the core;

a housing configured to extend longitudinally about the core and the baffle; and an end cap defining a front end of the suppressor, said end cap configured to attach to a front end of the housing, wherein:

the core comprises a plurality of annular segments extending longitudinally, said plurality of annular segments spaced apart and supported by a plurality of rails attached to each of the annular segments of the plurality of annular segments such that the plurality of rails and plurality of annular segments form a cage;

the plurality of annular segments and the plurality of rails are integrally formed;

the core further comprises a plurality of bushings configured to engage a radially inward surface of the cage, wherein said radially inward surface of the cage engages the plurality of bushings via threads;

the plurality of bushings are longitudinally spaced from one another when the suppressor is assembled; and each bushing of the plurality of bushings has a rear end that is beveled such that a rear edge of the bushing has a larger diameter than a minimum diameter of the bushing and the minimum diameter of the bushing is approximately equal to or larger than a bore diameter of the barrel of the gun.

16. The suppressor of claim 15, wherein:

the rear edge of each bushing of the plurality of bushings is a hyperbolic paraboloid.

* * * * *